United States Patent [19]

Ibrahim et al.

[11] 4,404,816

[45] Sep. 20, 1983

[54] MODULAR REFRIGERATION ASSEMBLY HAVING AIR DEFROST SYSTEM

[75] Inventors: Fayez F. Ibrahim, Niles; Terry Wessel, Three Oaks, both of Mich.

[73] Assignee: Tyler Refrigeration Corporation, Niles, Mich.

[21] Appl. No.: 254,134

[22] Filed: Apr. 14, 1981

[51] Int. Cl.[3] ..... F25D 21/12

[52] U.S. Cl. ..... 62/282

[58] Field of Search ..... 62/282, 82, 151

[56] References Cited

U.S. PATENT DOCUMENTS

| | | | |
|---|---|---|---|
| 2,124,268 | 7/1938 | Williams | 62/282 X |
| 2,466,876 | 4/1949 | Brouse | 62/282 |
| 2,525,868 | 10/1950 | Corhanidis | 62/282 |
| 2,525,869 | 10/1950 | Corhanidis | 62/282 |
| 3,850,003 | 11/1974 | Beckwith et al. | 62/282 X |
| 4,072,488 | 2/1978 | Johnston | 62/282 |
| 4,208,884 | 6/1980 | Popham | 62/282 |
| 4,300,358 | 11/1981 | Hino et al. | 62/282 X |

*Primary Examiner*—Albert J. Makay
*Assistant Examiner*—Harry Tanner
*Attorney, Agent, or Firm*—LeBlanc, Nolan, Shur & Nies

[57] ABSTRACT

An improvement in refrigeration assemblies for use in conjunction with cooler structures in which food products are preserved in which an assembly of unitary, modular construction is utilized to selectively provide the refrigeration of the air mass. The assembly can be air defrosted by arranging for the flow through of ambient air to defrost the evaporator coils. At the same time, the flow of ambient air can be blocked against entry into the refrigerated air mass by the use of movable baffles. Cover gates are arranged on the assembly to permit the through flow of ambient air during the defrost cycle of operation.

The refrigeration assemblies can be employed for retrofitting and on an interchangeable basis for structures to be refrigerated.

14 Claims, 7 Drawing Figures

MODULAR REFRIGERATION ASSEMBLY HAVING AIR DEFROST SYSTEM

BACKGROUND OF THE INVENTION

The present invention relates to a modular refrigeration assembly for use in conjunction with a refrigerated structure such as a walk-in cooler or freezer employed in retail and wholesale food outlets. More specifically, the invention relates to an assembly which provides an easily replaced unit for generating a refrigerated air flow for such a structure. The term "refrigerated" in accordance with the present invention is intended to incorporate structures wherein the temperature of the contained air mass is maintained at or in excess of 32° F., such as storage structures utilized for milk and fresh foods and those structures in which the air is maintained below 32° F., for the maintenance of frozen food.

An increased market demand has occurred in the retail food outlet equipment industry for low energy consumption refrigerated storage structures in order to reduce operating costs wherever possible. In the operation of all types of refrigerated structures, it is desirable to include a system for automatically defrosting the evaporator coils. The defrost cycle can be actuated either at set periodic time intervals or when the frost build-up within the coils has reached a certain predetermined condition. The latter type of system is typically thermostatically controlled so as to switch from a refrigeration cycle to a defrost cycle of operation. In this manner of operation, it is possible to avoid any significant frost build-up within the display cabinet such that inoperability and spoilage of food products would occur.

There have been three different approaches for defrosting refrigerated display cabinets in this art. These are, utilizing the electric resistance heaters; passing a compressed refrigerant gas having a high specific heat through the refrigeration coils; and, circulating ambient air through an air conduit in which the refrigeration coils are positioned. Due to the increased cost of energy, more emphasis has been placed on the utilization of ambient air defrost systems as an alternative to the electrical resistant heaters or compressed refrigerant gas defrost systems.

Ambient air defrost systems are more economical to operate due to the fact that the existing specific heat in the ambient air can be employed as the energy source to melt the frost and ice which has accumulated on the evaporator coils. In either the electric resistance heaters or the compressed refrigerant gas systems, additional energy must be expended in order to defrost the coils. The structural components of the air defrost systems must be arranged in such a manner that the warm ambient air is brought into contact with the evaporator coils in a direct and positive manner without incurring large capital costs for the necessary ducts and additional air moving machinery. If an overly complicated air defrost system is employed, the additional capital costs can only be recovered after long operating time periods which have been recently significantly extended due to the rising cost of investment capital.

Another problem in the construction of refrigerated structures for the storage of food products is that the refrigeration systems are sometimes incorporated into the structure in such a way that repair and maintenance is rendered extremely difficult. Another problem with the inaccessibility of the refrigeration machinery is that retail store managers cannot upgrade the energy efficiency of the existing equipment without additional significant retrofitting investments.

The present invention is a solution to the above problems in that a modular refrigeration assembly having an ambient air defrost system incorporated therein is provided for use with walk-in coolers and freezers. The assembly is of a unitary construction which enables the low cost retrofitting of existing refrigeration structures.

U.S. Pat. Nos. 2,923,137 to Swanson; 2,961,845 to Kennedy; 3,698,205 to Perez; 4,023,378 to Kennedy, Butts and Steelman; 4,117,697 to Myers and Kennedy; and 4,124,996 to Kennedy, Butts and Steelman describe refrigerated structures in which a food storage space is incorporated together with a merchandiser display section. By construction, the refrigeration equipment used in conjunction with these structures is contained within them in such a manner that repair and maintenance access is limited. U.S. patent application Ser. No. 6,074 filed Jan. 24, 1979 to Myers, Kennedy, and Perez and assigned to the same assignee as is the present application shows another type of a refrigerated structure. In U.S. Pat. No. 4,117,697 an ambient air band B is utilized as a third air curtain, but ambient air is not employed in order to defrost the refrigeration coils.

U.S. Pat. No. 4,072,488 to Johnston shows a glass door reach-in refrigerated display case in which an evaporator coil is located in the top portion of the case and wherein horizontal trap doors are opened in the top wall of the case in order to provide for an ambient air flow. The refrigeration coils of this case are integral with the entire cabinet structure and are not capable of independent use as a refrigeration assembly for separate structures containing cooled air masses. The refrigeration coil package is not a unit separate from the refrigerated display cases. The horizontal arrangement of the defrost doors also permits the accumulation of dust and debris on and around the horizontally disposed top which then results in contamination of the food storage space. This patent does not provide blocking baffles to protect the mass of the cooled air within the case from contact by the ambient air during the defrost cycle of operation.

Various types of air defrost systems have been employed with respect to refrigerated display cabinets used in retail food outlets. Exemplary of such prior art are: U.S. Pat. Nos. 3,403,525; 3,850,003 and 3,937,033 all to Beckwith et al; 3,082,612 to Beckwith; and 3,226,945 to Spencer.

SUMMARY OF THE INVENTION

An improvement in refrigeration assemblies for use in conjunction with structures which enclose cooled air masses for the preservation of food products is provided. The assembly is of unitary, modular construction and can be utilized to selectively provide the refrigeration of air for a wide variety of storage structures. The assembly is provided with an air defrost system.

The assembly has provision for a smooth flow-through of ambient air during the defrost cycle. Cover gates are arranged to block the ambient air inlet and outlet openings during the refrigeration cycle of operation. In the preferred embodiments, blocking baffles are also employed to close the refrigerated air inlet and outlet ports during the defrost cycle of operation. Also, auxiliary air moving means can be employed during the defrost cycle of operation. The assembly may be incorporated into the wall structure of modular designed refrigerated structures as well as being constructed as a separate unitary, modular system.

It is therefore, an object of the present invention to provide an improved refrigeration assembly for interchangeable use in conjunction with structures which enclose a mass of cooled air and a method for operating the same.

Another object of the present invention is to provide a modular refrigeration assembly in which refrigeration coils are positioned for defrosting by an ambient air defrost system in a simple and direct manner.

Specific preferred embodiments of the invention will be described below with reference to the appended drawing figures.

Yet another object is to provide a modular refrigeration assembly in which cover gates are arranged to block ambient air flow during the refrigeration cycle of operation and to permit an ambient air flow-through during a defrost cycle of operation.

A further object is to provide the refrigeration assembly with blocking baffles to positively prevent the ambient air flow during the defrost cycle from flowing into the refrigerated air mass contained within a refrigerated structure.

DESCRIPTION OF THE PREFERRED EMBODIMENTS

Figure 1:
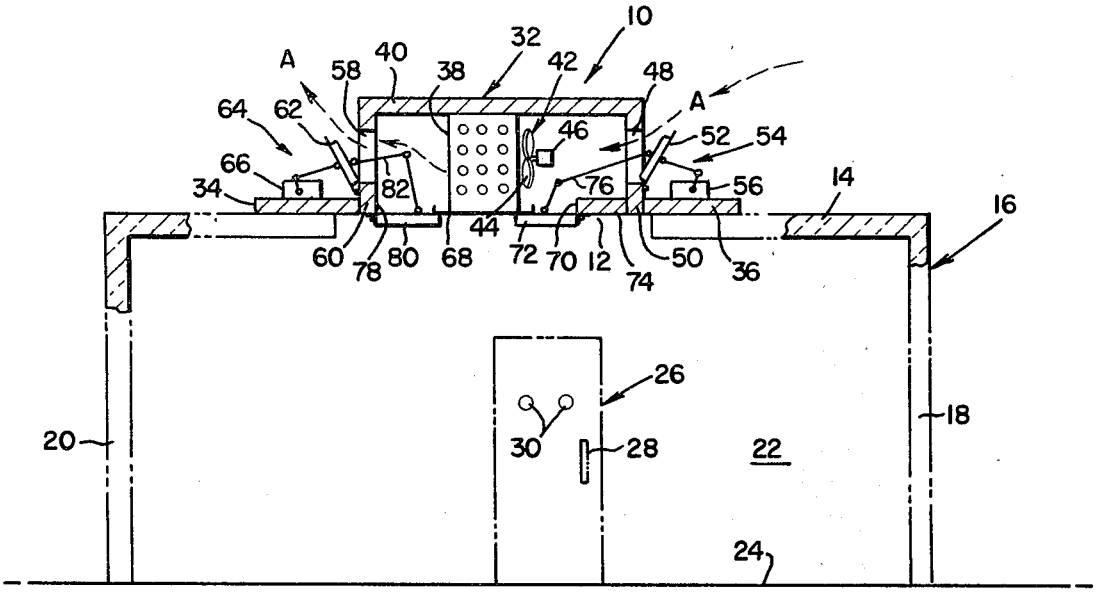
FIG. 1 is a schematic view of the refrigeration assembly taken in cross-section when mounted on the top wall of a refrigerated structure.
Figure 2:
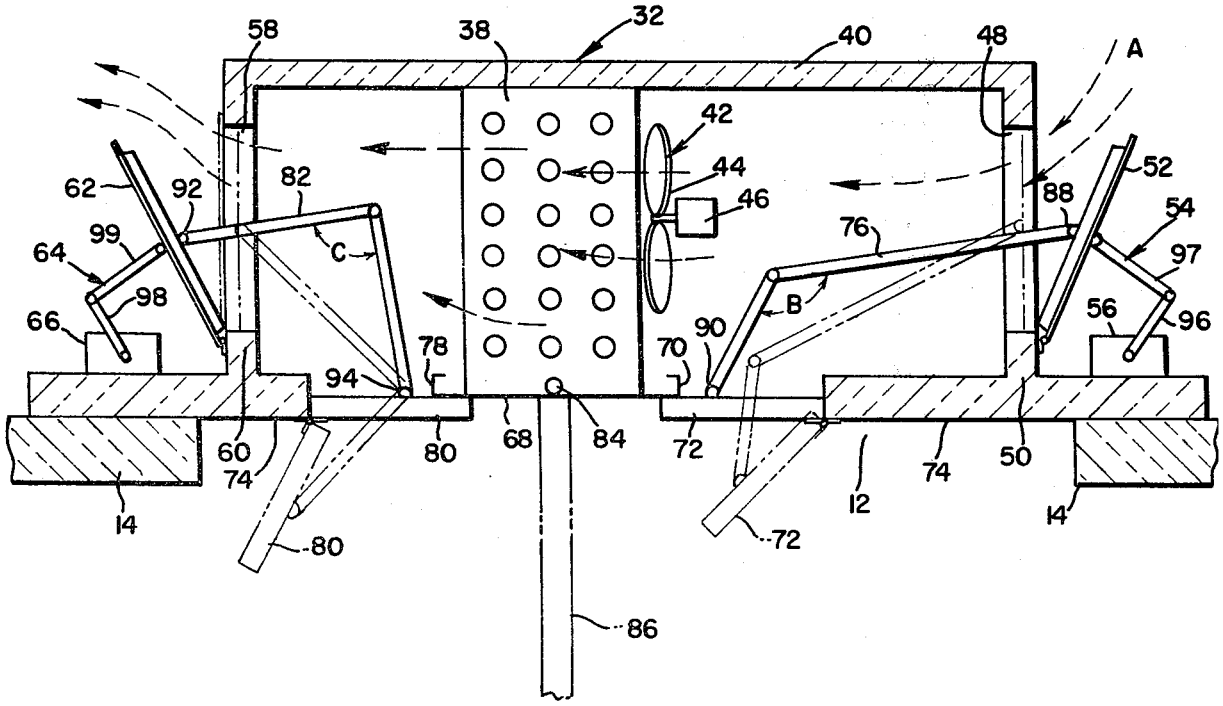
FIG. 2 is a detailed view of the refrigeration assembly shown in FIG. 1.

Referring now to FIGS. 1 and 2, a refrigeration assembly 10 of modular, unitary form is shown mounted over an opening 12 formed in the top wall or ceiling 14 of a structure or room 16 which has side walls 18 and 20 and a rear wall 22 resting on a floor 24. Rear wall 22 is provided with an access door 26 which has an operating handle 28 and viewing ports 30.

Refrigeration assembly 10 is formed of a modular housing 32 which is supported over opening 12 by base extension portions 34 and 36. A low temperature element 38 consisting of a flowthrough box with refrigerator evaporator coils arranged therein is supported from the under surface of top wall 40 of assembly housing 32. An air moving means 42 consisting of a fan 44 and a connected motor 46 is also arranged within assembly housing 32 so that air can be circulated through the evaporator coils of low temperature element 38. An ambient air inlet opening 48 is formed in end wall 50 of assembly housing 32. An inlet cover gate 52 is arranged for pivotal movement into and away from closed position with respect to the air inlet opening 48. The movement of cover gate 52 is provided by a linkage system 54 operated by an operating means 56 which consists of a motor-gear box unit. On the opposite end of the modular assembly housing 32 an ambient air outlet opening 58 is formed in end wall 60 and an outlet cover gate 62 is pivotally attached to the outside of end wall 60 and arranged to move into blocking position with respect to the air outlet opening 58. Cover gate 62 is pivoted by means of motive force transmitted through mechanical linkage system 64 which is powered by an operating means 66 which consists of a second motor-gear box unit.

When the air inlet cover gate 52 and the outlet cover gate 62 are in open position as shown in FIG. 1, ambient air, shown by the dotted arrows A can be moved through assembly housing 32 by air moving means 42 and passed through the evaporator coils of the low temperature element 38 in order to defrost the same. A condensate collection tray 68 is arranged below element 38 for the collection of run-off water during the defrost cycle of operation.

During the defrost cycle, when the air inlet cover gate 52 and the outlet cover gate 62 are in opened position, the refrigerated air inlet port 70 is blocked by blocking baffle 72. Baffle 72 is pivotally connected to bottom wall 74 of assembly housing 32 and is operated between blocking and open positions by a kinked operator link 76 which is connected to the inside surfaces of the blocking baffle 72 and the cover gate 52. In a like manner, the refrigerated air outlet port 78 is provided with a blocking baffle 80 which is pivotally connected to bottom wall 74 of the assembly housing 32. The blocking baffle 80 is moved between blocking positions and open positions by means of an operator link 82 which is connected between the interior surfaces of the blocking baffle 80 and the ambient air cover gate 62.

The operation of the refrigeration assembly 10 is shown in FIG. 2 wherein the ambient air band A is moved through the ambient air inlet port 48, through low temperature element 38 and out of ambient air outlet opening 58 by air moving means 42 when the cover gates 52 and 62 are in opened positions as shown by the solid lines. This flow of ambient air A occurs during the defrost cycles of operation of the refrigeration assembly 10. The use of ambient air as a defrost energy source results in the savings of operational energy.

At the termination of a defrost cycle of operation, a defrost control means (not shown) causes the operator means 56 and 66 to move the cover gates 52 and 62, respectively, into blocking positions with respect to the ambient air inlet and outlet openings, respectively. This movement is transmitted through the linkage systems 54 and 64 and via the fixed-angle operator links 76 and 82 to the blocking baffles 72 and 80 which are then pivoted away from the blocking positions into the opened positions shown by the dotted lines. Refrigerated air can then flow through the air inlet port 70 and the refrigerated air outlet port 78. The air moving means 42 is then operated to cause a refrigerated air band to flow through the air inlet port 70, through the low temperature element 38 and into contact with the evaporator coils which then remove heat from the cooled air. The air is then circulated downwardly through refrigerated air outlet port 78 and back into the mass of air contained within structure 16. This refrigerated air flow is utilized as needed during the refrigeration cycle of operation.

At the termination of the refrigeration cycle, the defrost control means causes the operator means 56 and 66 to move the cover gate into the outwardly opened positions as shown in the solid lines which then cause blocking baffles 72 and 80 to block the refrigerated air inlet and outlet ports 70 and 78, respectively. The air moving means 42 then causes the ambient air band A to move through the low temperature 38 in order to defrost the same. A drain line 84 is shown connected to the condensate run-off tray 68. If desired, a partition 86 can be placed under the mid portion of the refrigeration assembly 10 in order to prevent circulation of the refrigerated air band in a circular fashion through the refrigerated air inlet and outlet ports.

The top wall 40, and end walls 50 and 60 of refrigeration assembly 10 can be insulated in order to decrease heat transfer into the assembly.

The arrangement of cover gates 52 and 62 so that they open toward the outside of the refrigeration assembly 10 is advantageous in that these cover gates do not freeze shut as would occur if they opened inwardly. The refrigeration assembly 10 also provides for easy serviceability and maintenance by reason of the fact that all of the components are above the upper most surface of top wall or ceiling 14 of the structure to be cooled. Hence, the unitary assembly 10 can be used to drop into place on an opening 12 formed in the upper wall 14 of a structure to be cooled. The assembly can, of course, be used on a vertical wall or other structural member of an enclosed space. It can be easily interchanged between structures to be refrigerated.

The assembly bottom wall 74 can have various configurations with respect to the end walls 50 and 60 and the fixed angles B and C of operator links 76 and 82 can be correspondingly changed. The operator link 76 is attached to the inner surface of cover gate 52 by a pivot connection 88 and to the interior surface of blocking baffle 72 by another pivotal connection 90. In a like manner, the operator link 82 is attached to the inner surface of cover gate 62 by a pivotal connection 92 and is connected on its other end to the interior surface of blocking baffle 80 by a pivotal connection 94.

If desired, the refrigeration assembly 10 can be used without the blocking baffles 72 and 80 which then also means that the operator links 76 and 82 are not needed. In such a modification, the flow through of ambient air band A during the defrost cycle is arranged to be the lowest pressure drop path for the ambient air whereby the air is not forced down into the interior of the structure 16 which contains the mass of cooled air.

It should be noted that all of the operating elements of the refrigeration assembly 10 are connected to and contained within the modular assembly housing 32. Consequently, the refrigeration assembly 10 can be manufactured and installed as a complete "drop-in" unit which requires no other modification of the structure 16 which is to be cooled thereby. The assembly housing 32 can be moved between structures and lifted off of top wall 14 for maintenance.

The operator links 54 and 64 consist of crank arms 96 and 98 which are connected to the armatures of the motor-gear box assemblies 56 and 66, respectively. The motor-gear box assemblies disclosed herein are designed to provide oscillatory motion for the crank arms 96 and 98. Push rods 97 and 99 are pivotally connected by one end thereof to the crank arm ends and by the other end thereof to the outside surfaces of the cover gates 52 and 62.

Figure 3:
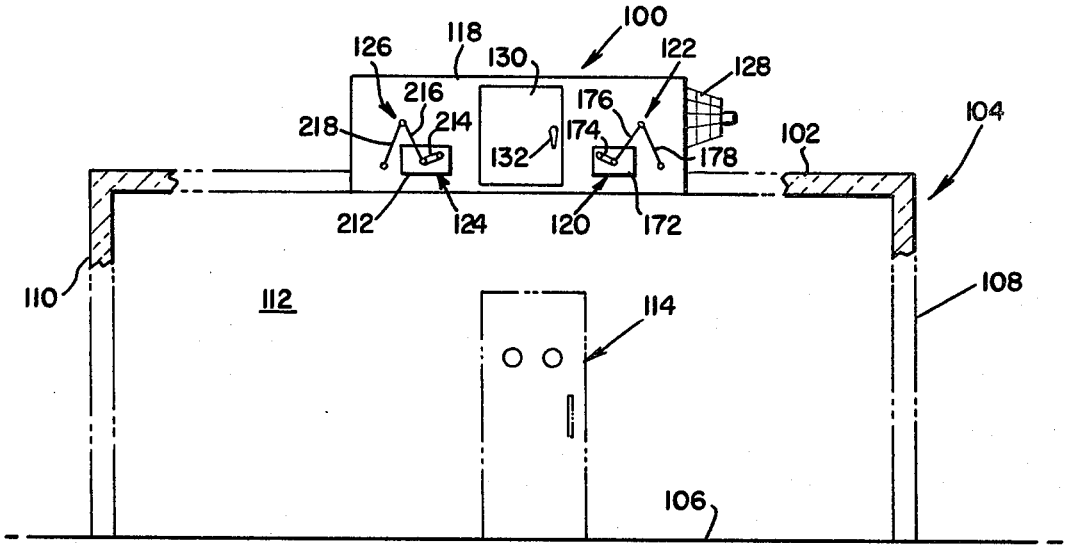
FIG. 3 is a schematic view of a second modification of the refrigeration assembly shown in side elevation when mounted on the top of a refrigerated structure.
Figure 4:
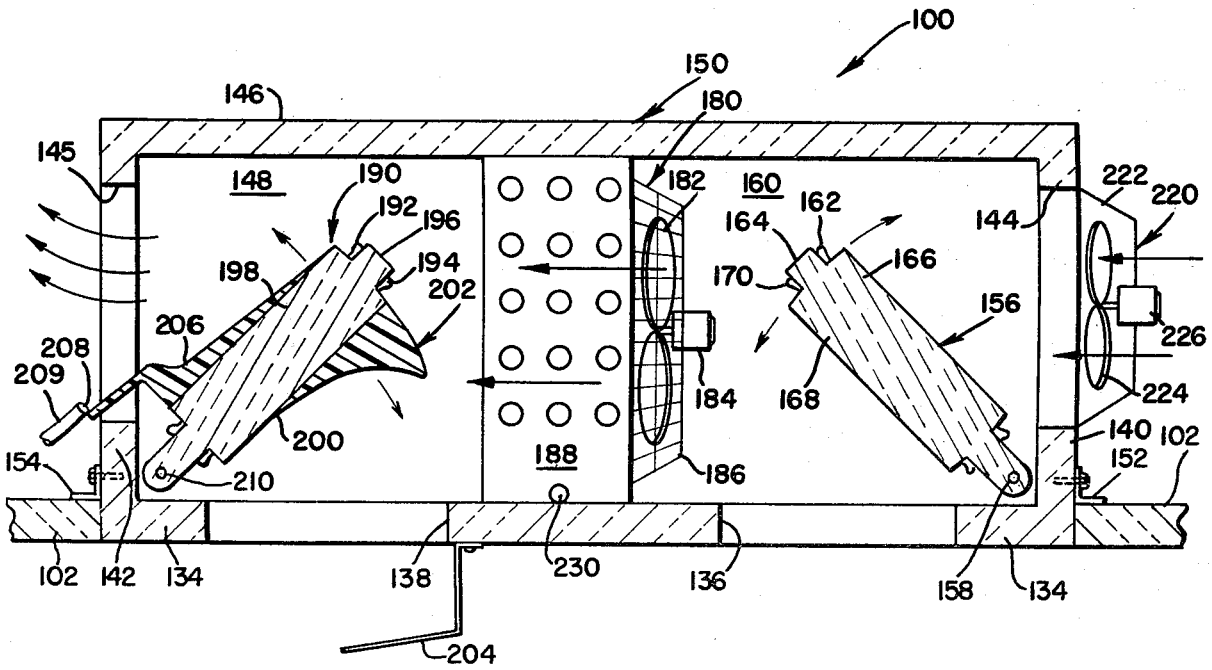
FIG. 4 shows a detailed cross-sectional elevation view of the refrigeration assembly shown in FIG. 3.

Referring now to FIGS. 3 and 4, a second embodiment of the present invention is shown as refrigeration assembly 100 which is set into an opening in the top wall or ceiling 102 of structure 104 which contains a mass of cooled air. The structure 104 rests on a floor surface 106 and has end walls 108 and 110 and a rear wall 112. An access door 114 is also provided in rear wall 112.

As shown by FIG. 3, refrigeration assembly 100 has a side wall 118 on which are mounted an air inlet operating means 120 which has a linkage system 122 connected thereto and an air outlet operating means 124 which has an operator linkage system 126 attached thereto. The right hand end portion of refrigeration assembly 100 contains an auxiliary fan housing 128. An access door 130 is formed on side wall 118 and has an operating handle 132 thereon.

FIG. 4 shows a detailed cross-sectional view of the refrigeration assembly 100 wherein a bottom wall 134 contains a refrigerated air inlet port 136 and a refrigerated air outlet port 138. End wall 140 has an ambient air inlet opening 144 and opposite end wall 142 contains an ambient air outlet opening 145 formed therethrough. A top wall 146 and a rear wall 148 complete the modular housing 150 of the refrigeration assembly 100.

Assembly housing 150 is maintained within an opening in top wall 102 by a first and a second bracket 152 and 154.

The ambient air inlet opening 144 can be closed by an inlet cover gate 156 which pivots about rod 158 within the interior chamber 160 in the assembly housing 150. An air seal ring 162 is formed in the core portion 164 of cover gate 156 which is also provided with an external extension area 166 and a internal extension area 168. Extension area 166 is designed to fit into blocking position within ambient air inlet opening 144. A second air sealing ring 170 is formed on the opposite side of the core portion 164 about the internal extended area 168 for forming an air tight seal with respect to the refrigerated air inlet port 136 located in bottom wall 134 of the assembly housing 150. Cover gate 156 is operated between blocking positions with respect to the ambient air inlet opening 144 and the refrigerated air inlet port 136 through the operation of operating means 120 which consists of a motor-gear box assembly 172 which has the output crank arm 174 pivotally connected to a push rod 176 which is, in turn, pivotally connected to the crank arm 178 of the access member 158. The crank arm is fixed to one end of rod 158. The crank arms and push rod are shown in FIG. 3.

Operating means 120 is actuated by a defrost control means to cause the cover gate 156 to move between the two above described blocking positions. When the cover gate 156 closes off the ambient air inlet opening 144, refrigerated air can be circulated upwardly through refrigerated air inlet port 136 from the cooled air mass contained within structure 104 by means of the air moving means 180 which consists of a fan 182 powered by a motor 184 which are both supported within a cage 186 on one side of the low temperature element 188. This element 188 is supported by the top wall 146 and bottom wall 134 of the refrigerated assembly 150. The refrigerated air band established by circulation of fan 182 is then caused to flow downwardly through the refrigerated air outlet port 138 during the refrigeration cycle of operation.

At the initiation of a defrost cycle of operation, the defrost control means causes the operator means 120 to move the cover gate 156 into blocking position with respect to the refrigerated air inlet port 136 and to thus open the ambient air inlet opening 144. Simultaneously therewith, cover gate 190 in the outlet end of the refrigeration assembly 150 is caused to move away from blocking position with respect to the ambient air outlet opening 145 and into the blocking position with respect to the refrigerated air outlet port 138. Cover gate 190 is constructed in a similar fashion with respect to cover gate 156 in that first and second air seal rings 192 and 194 are formed on a core portion 196 and extended areas 198 and 200 are formed for moving into blocking positions with respect to the air outlet opening 145 and the refrigerated air outlet port 138, respectively. A deflector shield 202 is formed on extended area 200 in order to provide for a smoother flow of the refrigerated air downwardly through outlet port 138. As shown in FIG. 4, an additional deflector baffle 204 can be affixed to the undersurface of bottom wall 134 in order to aid in the flow of refrigerated air in a generally circulatory pattern within the refrigerated structure 104.

Also formed on cover gate 190 is a condensate skirt 206 which is secured to the outer extended area 198 in order to provide for the run-off of condensate water into drain 208 located on the lower edge portion of skirt 206. This drain can have a flexible tube 209 to provide for movement of the skirt 206. This condensate run-off sleeve allows the water condensed from the atmosphere to run-off without freezing to seal ring 192 which might otherwise occur due to the action of the refrigerated air against the interior surface of the cover gate 190.

The cover gate 190 is pivoted about a rod 210 which is supported in the outer walls of assembly 150 and is rotated by the operator linkage system 126 which is powered by operating means 124. This operator means consists of a motor and gear box assembly 212 which has the output crank 214 pivotally connected by one end thereof to a push rod 216 which is, in turn, pivotally connected to the crank arm 218 which is affixed to the end of rod 210.

As can be seen from a comparison of FIGS. 3 and 4, the access door 130 allows repair and maintenance to the evaporator coils in the low temperature element 188 and to the fan and motor combination 182 and 184.

If desired, an auxiliary air moving means 220 can be installed on end wall 140 in order to force ambient air into and through the ambient air inlet opening 144 during the defrost cycle. An auxiliary fan housing 222 is secured to wall 140 and for supporting the fan 224 and the associated motor 226. The auxiliary air moving means 220 is actuated by the defrost control means after the cover gates 156 and 190 have been moved into blocking positions over the refrigerated air inlet and outlet ports, respectively. The operation of the auxiliary air moving means allows the volumetric flow of ambient air to be greater during the defrost cycle of operation than during the refrigeration cycle of operation.

A drain 230 is shown located immediately under the low temperature 188 in order to drain off water during the defrost cycle of operation.

The operation of the refrigeration assembly 100 between the refrigeration and defrost cycle is the same as described with respect to FIGS. 1 and 2 above. The evaporator coil boxes 38 and 188 are, of course, connected in a refrigeration system including a compressor and condenser located at another position.

Figure 5:
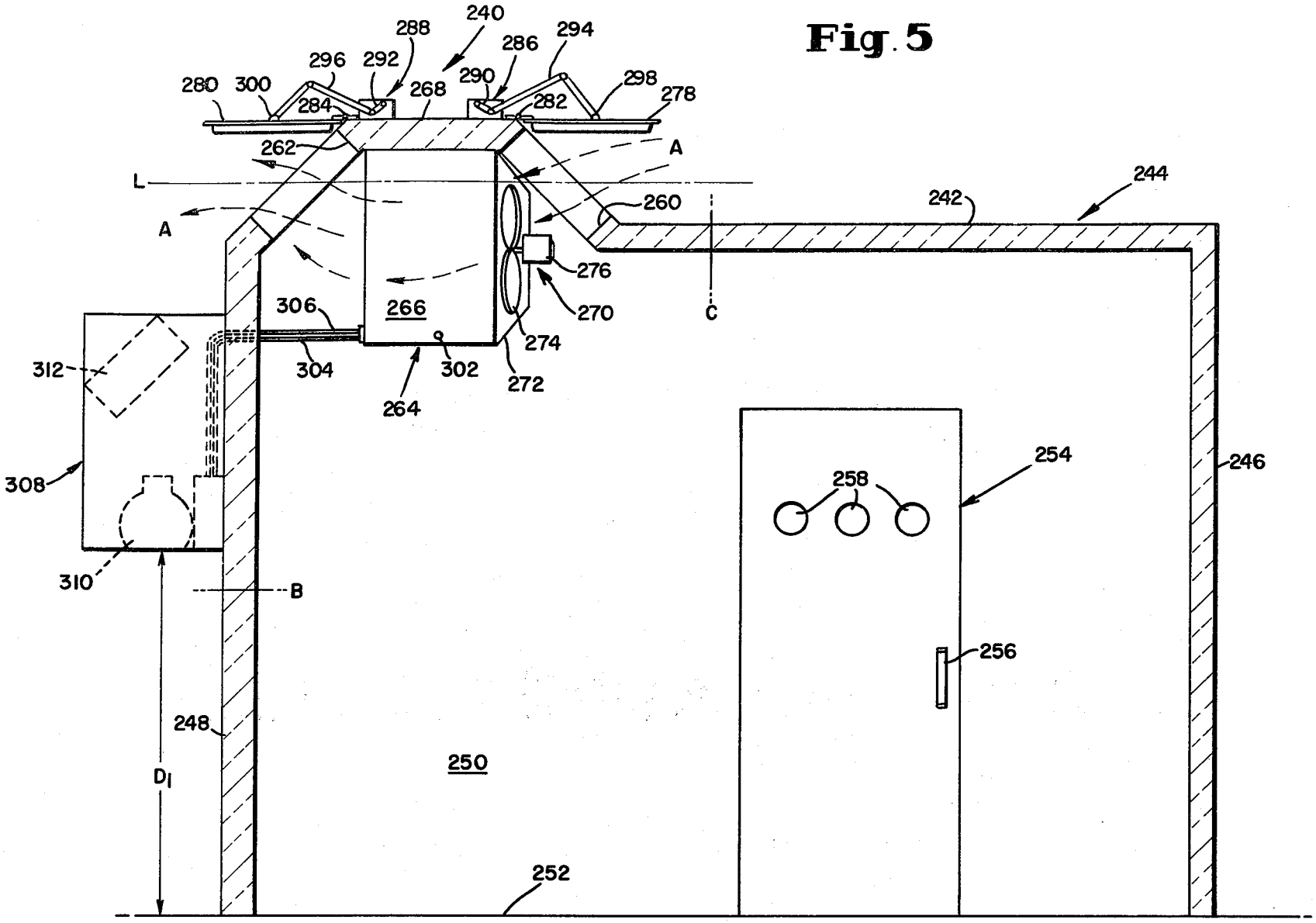
FIG. 5 shows a third modification of the refrigeration assembly of the present invention in which the assembly is formed as a modular portion of a refrigerated structure.
Figure 6:
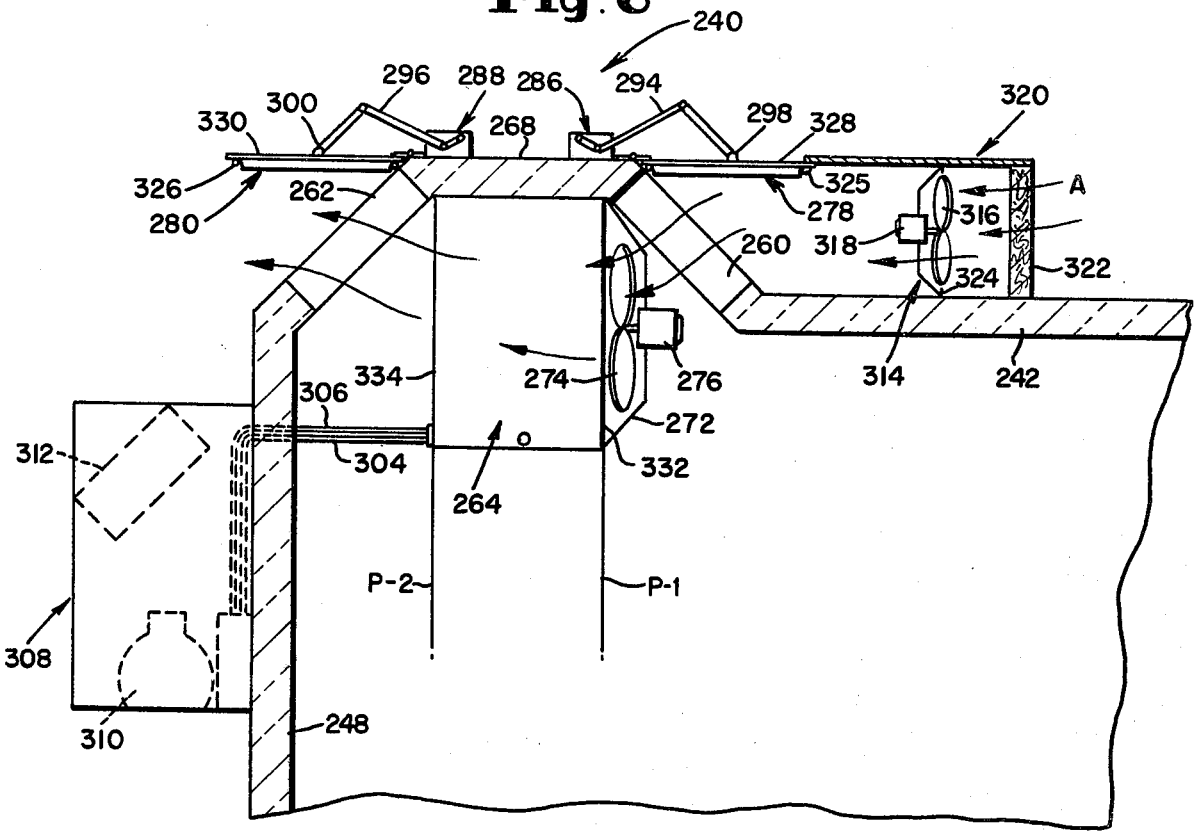
FIG. 6 shows a second embodiment of the modular portion of the refrigerated structure shown in FIG. 5 which incorporates the refrigeration assembly.

Referring now to FIGS. 5 and 6, a refrigeration assembly 240 is formed integrally in the top wall 242 of a structure 244 in which a mass of cooled air is to be maintained. The structure 244 has end walls 246 and 248 and a rear wall 250 which rests on a ground surface 252 such as a cement floor in a retail food outlet. The structure 244 is formed with an access door 254 having a handle and latch 256 and viewing ports 258.

The refrigeration assembly 240 is elevated above the upper plane of top wall 242 in order to provide for the ambient air inlet opening 260 and the ambient air outlet opening 262 which are arranged along a line L which passes through the low temperature element 264 which consists of an evaporator coil box 266 affixed to the upper wall 268 of the refrigeration assembly 240. An air moving means 270 is supported by a bracket 272 and consists of a fan 274 and a motor 276. The ambient air inlet and outlet openings 260 and 262 have cover gates 278 and 280 arranged for pivotally closing thereupon about the pivot axes 282 and 284, respectively. The cover gates 278 and 280 are pivoted by action of the operator means 286 and 288 which consist of motor-gear box assemblies arranged to have oscillatory armature motion. The oscillating output crank arms 290 and 292 are each connected to fixed angle push rods 294 and 296, respectively, which are each, in turn, pivotally connected by pins 298 and 300 to the outer surfaces of the cover gates 278 and 280, respectively. Upon the actuation of the operator means 286 and 288 by the defrost control means the cover gates 278 and 280 shown as being substantially planar are lifted into the solid line positions shown in FIG. 5 in order to permit the flow through of an ambient air band A in order to defrost the low temperature element 264. The return motion for closing the cover gates 278 and 280 allows closure through the operation of the push rods and operator levers aided by gravitational force. Low temperature element 264 is equipped with a condensate drain line 302. The lower resistance to air flow in along the line L is relied upon in this modification to prevent excessive circulation of the ambient air within the mass of the cooled air contained within the structure 244.

The evaporator coils in low temperature element 264 are connected via lines 304 and 306 to an externally mounted condensing unit 308 which contains a motor and compressor combination 310 and a condensing coil set 312. The condensing unit 308 can be mounted on a side wall of the structure 244 as shown and conventional fan and motors are arranged therefor. The mounting of the external condensing unit can be at various heights D from from the surface of floor 252, for example, four to five feet.

During the operation of the refrigeration assembly 240, upon the completion of the defrost cycle of operation, the motor-gear boxes 286 and 288 are operated to move the cover gates 278 and 280 into blocking positions with respect to the ambient air inlet and outlet ports 260 and 262 and the fan 274 continues to operate in order to circulate the mass of cooled air within the structure 244 through the evaporator coils in the low temperature element 264 in order to maintain the low temperature thereof.

As shown in FIGS. 5 and 6, the walls 244, 246, and 248 of structure 244 and the top wall 268 of the refrigeration assembly are insulated in order to restrict heat transfer from the ambient air into the cooled air within the structure 244. The entire structure 244 together with the refrigeration assembly 240 can be manufactured as a unit and installed in retail food markets. Alternatively, the assembly 240 and the condensing unit 308 can be joined to a modular portion of the refrigerated structure 244 such as illustrated by the break lines B and C in FIG. 5 and by the FIG. 6 view. In this modular form the assembly 240 and the unit 308 can be used to form an integral, inter-fitted part of a refrigerated structure 244.

As shown in FIG. 6, an auxiliary air moving means 314 can be provided by incorporating a fan 316 and an associated motor 318 in an auxiliary fan housing 320 which can be also designed to accommodate an air filter 322 which will then rest within the housing 320 on the upper surface of top wall 242. The auxiliary air fan housing 320 can form a conduit for the ambient air band A upon the full opening of the cover gate 278 into the position as shown in FIG. 6. A support baffle 324 is provided for positioning fan 316 and motor 318 within the housing 320.

If desired, seal rings 325 and 326 can be provided about the base portions 328 and 330 of the two cover gates 278 and 280, respectively.

As can be seen in FIG. 6 and in each of the FIGS. 1, 2, 4, and 5 the low temperature elements 38, 188 and 264 are formed with an air inlet area 332 which is located in a first plane P-1 and an air outlet area 334 which is located in a second plane P-2. Both the ambient air band A and the refrigerated air band are circulated through the inlet area 332 and the outlet areas 334 during the operation of both the defrost and the refrigeration cycles of operation. The planes P-1 and P-2 can be positioned at acute angles with respect to the planes passing through the air inlet and outlet opening 260 and 262 or these two planes can be substantially parallel to planes passing through the ambient air inlet and outlet openings as shown in FIGS. 1–4. Alternatively, an A-frame evaporator coil set can be employed for any of the embodiments of the present invention whereby the planes of the outer surfaces of the low temperature element 264 will be more closely parallel with respect to the corresponding ambient air inlet and outlet openings as illustrated in FIGS. 5 and 6.

The modular refrigeration assemblies described herein function as refrigerated air supply units for cooler structures, particularly, walk-in coolers. These units operate with low relative energy consumption due to the provision for air defrosting by ambient air flow-through. In operation, the units refrigerate a circulated air band by passing the air contained within the structure through an evaporator coil set which is connected to other elements of a refrigeration system. The refrigeration system is controlled for intermittent operation by a master control means which senses the need for operation of the refrigeration system by monitoring the temperature inside and outside of the structure and by integrating these with other inputs such as atmospheric conditions including humidity.

The master control means includes a defrost control subsystem which senses the need for defrosting the evaporator coil set through the sensing of the passage of time or the buildup of ice on the coils. The latter type of sensing can be implemented by employing a thermostat known as a Klixon. When the need for defrosting occurs the defrost control subsystem means causes the following sequence of operational steps:

1. The master control for the refrigeration system is switched over to the defrost control system and the flow of refrigerant in the evaporator coils is terminated.
2. The cover gates are moved out of the blocking positions in which these gates covered the ambient air inlet and outlet ports.
3. Step 2 also results in the blocking baffles closing the refrigerated air inlet and outlet ports by transmission of the motion of the gates to the blocking baffles through the connecting linkage systems.
4. The air circulation fan continues to operate, whereby ambient air is now drawn through the air inlet and outlet ports to defrost the coils.
5. The condensate water is then taken off through a drain line.
6. When the accumulated ice has been melted off from the coils the combined steps 2 and 3 are reversed so that the cover gates are returned to the blocking positions and the blocking baffles are opened to permit the flow of refrigeration air.
7. The refrigeration system is released to the control of the master control means whereby the refrigeration function is resumed.

The above sequence can be instituted at any time, day or night, due to the automatic functioning of the master control and defrost control means.

An existing structure to be refrigerated can be retrofitted by arranging top openings matched to the understructure of the refrigeration assembly structure. Installation and line connections are simple. The assembly can be used as needed and can be easily removed for use on another such structure.

The air circulation fan of the refrigerated assembly can be operated in a number of ways. It can be continuously operated at a constant speed in both the refrigeration and the defrost modes or the operation can be interrupted to follow the refrigeration and defrost demands. It can be interrupted during the change over from refrigeration to defrost modes. The speed of the fan during the defrost cycle can be greater than, less than, or the same as the speed used during the refrigeration cycle. The fan establishes the flow of both the refrigerated air band and the defrost air band. These bands can have flow paths which pass through different air outlet and inlet areas as shown by FIGS. 1–4 or through the same areas as shown by FIGS. 5–6.

The cover gates and blocking baffles can have separate operating mechanisms if desired as an alternative to the inter-connected linkages described herein. In this embodiment the separate mechanisms are individually controlled by the defrost control means.

The resilient air seal rings 162, 170, 192, 194, 325, and 326 shown in FIGS. 4 and 6 for preventing air blow-by can be formed from an elastomeric or rubber material of either the solid or pore-formed types.

Figure 7:
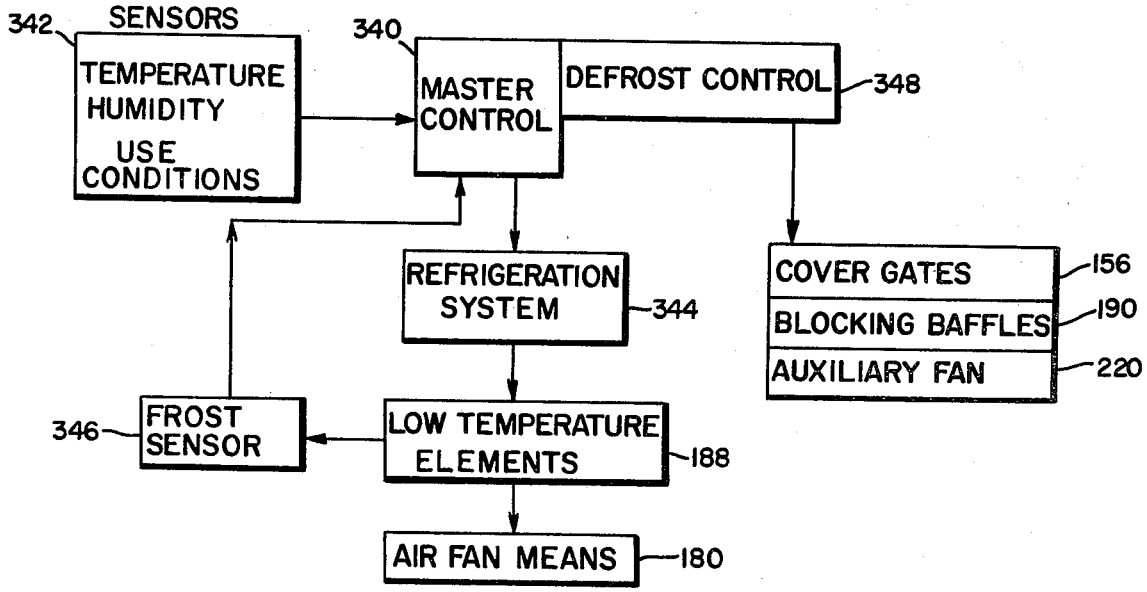
FIG. 7 shows a schematic control hierarchy for the refrigerated assemblies of the invention.

FIG. 7 shows the control hierarchy for the refrigerant assemblies 10, 100, and 240 described with respect to the second of these assemblies wherein a master control 340 receives electrical signals from sensors 342 to enable control of the refrigeration system 344 which includes the low temperature element 188 as well as the air moving fan means 180 during refrigeration cycles. Use condition sensors which provide signals based to use of the refrigerate structure can be provided as shown.

When a need for defrosting the low temperature is sensed by frost sensor 346 an electrical signal is transmitted to the master control 340 which then switches on the defrost control subsystem 348. This defrost control means then actuates the cover gates and blocking baffles, shown in assembly 100 (FIG. 4) as the dual function gates 156 and 190. The air fan means 180 can also be preferably operated during this defrost cycle. Upon completion of the defrost action by the ambient air flow-through the signal from the frost sensor 346 then actuates a return of the gates 156 and 190 to the ambient air blocking positions and termination of the operation of auxiliary fan 220 followed by a return of the control to the master control means 340 to permit the above sequence of operational steps to be carried out.

The invention may be embodied in other specific forms without departing from the spirit or essential characteristics thereof. The present embodiment is, therefore, to be considered in all respects as illustrative and not restrictive, the scope of the invention being indicated by the appended claims and all changes which come within the meaning and range of equivalency of the claims are, therefore, intended to be embraced therein.

What is claimed is:

1. In a refrigeration assembly in combination with a structure having side and top walls which encloses a mass of cooled air, and said assembly having at least one low temperature element arranged for contact by the refrigerated air, and an air moving means for circulating air into contact with said low temperature element; the improvement comprising:

an assembly housing for containing said air moving means and said low temperature element integrally formed at an elevated position in the top wall of said refrigeration assembly, ambient air inlet and outlet openings formed in said assembly housing, first and second substantially planar cover gates for blocking ambient air flow through said ambient air inlet and outlet openings during refrigeration cycles of operation, cover gates operating means operatively connected to said gates, a defrost control means operable in response to frost conditions to actuate said operating means for opening said cover gates upon th initiation of defrost cycles and to close said cover gates at the termination of the defrost cycles, said low temperature element affixed to the inner surface of said top wall and extending into the interior of said structure and surrounded by said mass of cooled air during a refrigeration cycle, and said low temperature element having air outlet and inlet areas defining opposing sides thereof, said air outlet and inlet areas positioned in a straight line path passing substantially perpendicularly between said ambient air inlet opening and said ambient air outlet opening to enable the formation of a low resistance straight line ambient air flow path through said low temperature element and through said assembly during defrost cycles of operation, and said air outlet and inlet areas of said low temperature element positioned to intersect a straight line flow path of the refrigerated air band moving within said structure during a refrigeration cycle, said air moving means operative to circulate both refrigerated and ambient air through said air inlet and outlet areas of said low temperature element in both the refrigeration and the defrost cycles of operation, respectively.

2. The improvement according to claim 1, wherein the planes of said ambient air inlet and outlet openings are positioned at acute angles to the planes of said air inlet and outlet areas of said low temperature elements.

3. The improvement according to claim 1, wherein both of said cover gates open outwardly from said assembly housing.

4. The improvement according to claim 1, wherein said low temperature element has a drain pan arranged therebelow to collect run-off moisture, and a drain line operatively connected to said drain pan.

5. The improvement according to claims 1 or 2, wherein an auxiliary air moving means is positioned in the straight line ambient air flow path through said ambient air inlet and outlet openings.

6. A refrigeration assembly in combination with a structure having side and top walls enclosing a mass of cooled air, said assembly having at least one low temperature element arranged for contact by refrigerated air, and an air moving means for circulating air into contact with said low temperature element, comprising:

an assembly housing for said air moving means and said low temperature element integrally formed at an elevated position in the top wall of said refrigeration assembly, ambient air inlet and outlet openings formed in said assembly housing, first and second substantially planar cover gates for blocking ambient air flow through said ambient air inlet and outlet opening during refrigeration cycles of operation, cover gates operating means operatively connected to said gates, a defrost control means operable in response to frost conditions to actuate said operating means for opening said cover gates upon the initiation of defrost cycles and to close said cover gates at the termination of the defrost cycles, said low temperature element extending from the inner surface of said top wall into the interior of said structure and surrounded by said mass of cooled air during a refrigeration cycle, and said low temperature element having air outlet and inlet areas defining opposite sides thereof, said outlet and inlet areas positioned in a straight line path passing substantially perpendicularly between said ambient air inlet opening and said ambient air outlet opening to enable the formation of a low resistance straight line ambient air flow path through said low temperature element and through said assembly during defrost cycles of operation, and said air outlet and inlet areas of said low temperature element positioned to intersect a straight line flow path of the refrigerated air band moving within said structure during a refrigeration cycle, said air moving means operative to circulate both refrigerated and ambient air through said air inlet and outlet areas of said low temperature element in both the refrigeration and the defrost cycles of operation, respectively.

7. The refrigeration assembly according to claim 6, wherein the planes of said ambient air inlet and outlet openings are positioned at acute angles to the planes of said air inlet and outlet areas of said low temperature elements.

8. The refrigeration assembly according to claim 6, wherein said assembly housing is fitted into an opening formed in at least one of the walls of said structure.

9. The refrigerated assembly according to claims 6, 7, or 8 wherein an auxiliary air moving means is positioned in the straight line flow path of the ambient air through said ambient air inlet and outlet openings.

10. The refrigeration assembly according to claims, 6, or 7, wherein said refrigeration assembly is integrally interfitted with a modular unit which includes one or more walls which form part of said structure containing the cooled air.

11. A refrigeration assembly in combination with a structure having side and top walls which encloses a mass of cooled air, comprising:

a refrigerated air opening in at least one of the walls of said structure for interfitting with said assembly, said assembly integrally formed at an elevated position in the top wall of said refrigeration assembly, said assembly having at least one low temperature element arranged for contact by a circulated refrigerated air band, said low temperature element having an air inlet area and an air outlet area arranged across at least two surfaces thereof, said air outlet and inlet areas of said low temperature element positioned to intersect a straight line flow path of the refrigerated air band moving within said structure during a refrigeration cycle, at least one air moving means for circulating air into contact with said low temperature element, operably arranged within said assembly, an assembly housing having ambient air inlet and outlet openings formed therein, first and second substantially planar cover gates for blocking ambient air flow through said ambient air inlet and outlet openings during refrigeration cycles of operation, cover gates operating means operably connected to said gates, a defrost control means operable in response to frost conditions to actuate said operating means for opening said cover gates upon initiation of defrost cycles and to close said cover gates at the termination of the defrost cycles, said low temperature element extending from the inner surface of said top wall into the interior of said structure and surrounded by said mass of cooled air during a refrigeration cycle, and said low temperature element having air outlet and inlet areas defining opposite sides thereof, said air outlet and inlet positioned in a straight line path passing substantially perpendicularly between said ambient air inlet opening and said ambient air outlet opening to enable the formation of a low resistance straight line ambient air flow path through said low temperature element during defrost cycles of operation, and said air moving means operable to circulate refrigerated and ambient air through said air inlet and outlet areas of said low temperature elements in both the refrigeration and defrost cycles of operation.

12. The refrigeration assembly according to claim 11, wherein an auxiliary air moving means are positioned in the ambient air flow path through said ambient air inlet and outlet openings.

13. The modular refrigeration assembly according to claim 11, wherein said housing is separably connected to said structure over said refrigerated air opening.

14. The modular refrigeration assembly according to claim 11, wherein said assembly housing is integrally interfitted as a modular portion of the walls of said structure which encloses the mass of cooled air.

* * * * *

UNITED STATES PATENT AND TRADEMARK OFFICE

CERTIFICATE OF CORRECTION

PATENT NO. : 4,404,816

DATED : September 20, 1983

INVENTOR(S) : Fayez F. Ibrahim

It is certified that error appears in the above-identified patent and that said Letters Patent is hereby corrected as shown below:

Column 11, line 41, change "th" to --- the ---.

Column 12, line 38, insert "air" before ---outlet---.

Signed and Sealed this

*Sixth* Day of *March 1984*

[SEAL]

*Attest:*

GERALD J. MOSSINGHOFF

*Attesting Officer*

*Commissioner of Patents and Trademarks*